US007406792B2

(12) United States Patent
Chang

(10) Patent No.: US 7,406,792 B2
(45) Date of Patent: Aug. 5, 2008

(54) PICTURE FRAME ASSEMBLY

(76) Inventor: Jung-Shih Chang, No. 32, Lane 25, Li Min Street, Ta Li City, Taichung Hsien (TW)

( * ) Notice: Subject to any disclaimer, the term of this patent is extended or adjusted under 35 U.S.C. 154(b) by 204 days.

(21) Appl. No.: 11/311,129

(22) Filed: Dec. 20, 2005

(65) Prior Publication Data

US 2007/0137081 A1 Jun. 21, 2007

(51) Int. Cl.
*A47G 1/06* (2006.01)

(52) U.S. Cl. ..... 40/781; 40/792; 40/732; 40/721; 40/711

(58) Field of Classification Search ..... 40/781, 40/792, 732, 711, 734, 794, 795, 572, 606.18; D06/302
See application file for complete search history.

(56) References Cited

U.S. PATENT DOCUMENTS 100,962 A * 3/1870 Adams ..... 40/721
4,583,309 A * 4/1986 Kane et al. ..... 40/711
6,467,210 B1 * 10/2002 Chang ..... 40/792

* cited by examiner

*Primary Examiner*—Lesley D. Morris
*Assistant Examiner*—Syed A Islam
(74) *Attorney, Agent, or Firm*—Browdy & Neimark

(57) ABSTRACT

A picture frame assembly includes a main body having a receiving portion for receiving a picture. A cover with a transparent portion is attached to the main body to against and display the picture received in the main body. A first urging means is disposed between the main body and the cover to produce a first urging force to urge against the cover to firmly be attached to the main body, and as the cover is released from the main body to urge against the cover to depart from the main body in a first direction. A second urging means is disposed between the main body and the cover to produce a second urging force to urge against the cover to depart from said main body in a second direction when the cover is released from the main body.

16 Claims, 3 Drawing Sheets

PICTURE FRAME ASSEMBLY

BACKGROUND OF THE INVENTION

1. Field of the Invention

The present invention relates to a picture frame assembly to enable a picture or the like to simply and easily be removed from or put into a frame body of the assembly.

2. Description of the Related Art

The conventional picture frames are generally designed to have a construction that a picture to be displayed must be put into the picture frame from the back side of the picture frame. It is time-consuming and inconvenient to replace a picture held in the picture frame or to put a new picture into the picture frame from the back side of the picture frame.

For eliminating this disadvantage, U.S. Pat. No. 6,467,210 has disclosed an improved picture frame which can enable a picture to be removed from or put into the picture frame from the front side thereof. The picture frame is designed to have a main body with a front side, a press member disposed in the front side of the main body, and an elastic member placed between the main body and the press member to press against the later to the former. The main body has a receiving portion with an opening provided in the front side of the main body such that the picture can be held in the receiving portion, displayed from the press member, and replaced from or put into through the front side of the main body. As being pushed in the direction toward the elastic member, the press member departs from the main body to facilitate the replacing of the picture.

The forgoing picture frame suffers from the disadvantage that the press member can only be pushed to depart from the main body in a vertical direction so that it is still difficult to take the press member away from the front side of the main body.

SUMMARY OF THE INVENTION

In view of this and other deficiencies of the prior art, it is thus one object of the present invention to provide an improved picture frame assembly which can simply and easily install a picture into or remove it from the picture receiving portion thereof.

Another object of the invention is to provide an improved picture frame assembly which can display the picture installed therein from the front side or the rear side thereof.

Thus, according to the idea of the present invention, a picture frame assembly comprises a main body having a receiving portion for receiving a picture. A cover having a transparent portion is releasably attached to the main body in such a way that when the cover is attached to the main body, the picture can be displayed through the transparent portion. A first urging means is disposed between the main body and the cover in such a way that the urging means can produce a first urging force to urge against the cover to firmly be attached to the main body, and to urge against the cover to depart from the main body in a first direction when the cover is released from said main body. A second urging means is disposed between the main body and the cover in such a way that when the cover is released from the main body, the second urging means produces a second urging force to urge against the cover to depart from the main body in a second direction.

These and other more detailed and specific objectives, features, functions, and advantages of the present invention will be better understood by reference to the following figures and detailed description which illustrate, by way of example, but a few of the various forms of the invention within the scope of the appended claims.

DETAILED DESCRIPTION OF THE INVENTION

Figure 1:
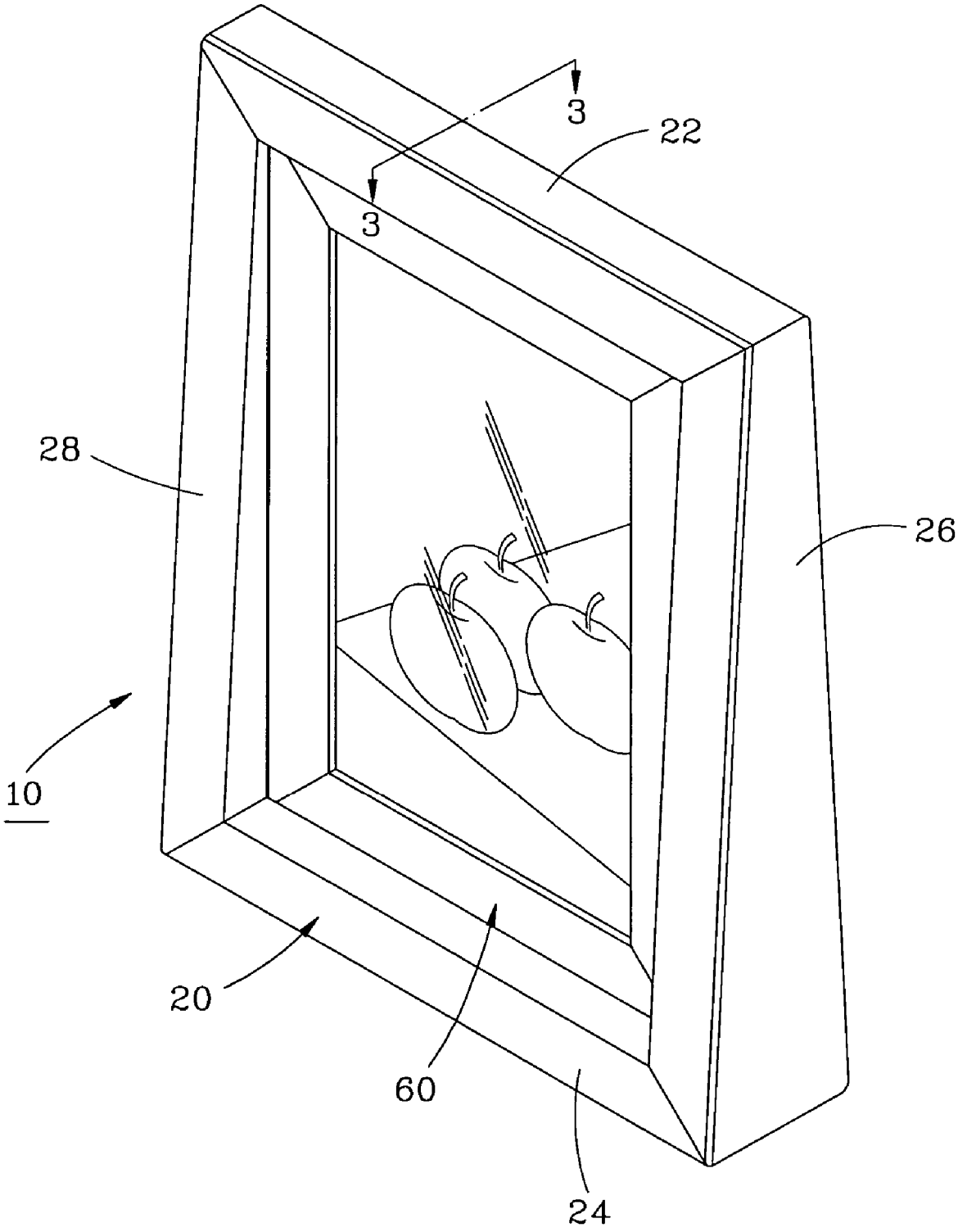
FIG. 1 is a front perspective view of a picture frame assembly according to the present invention.
Figure 2:
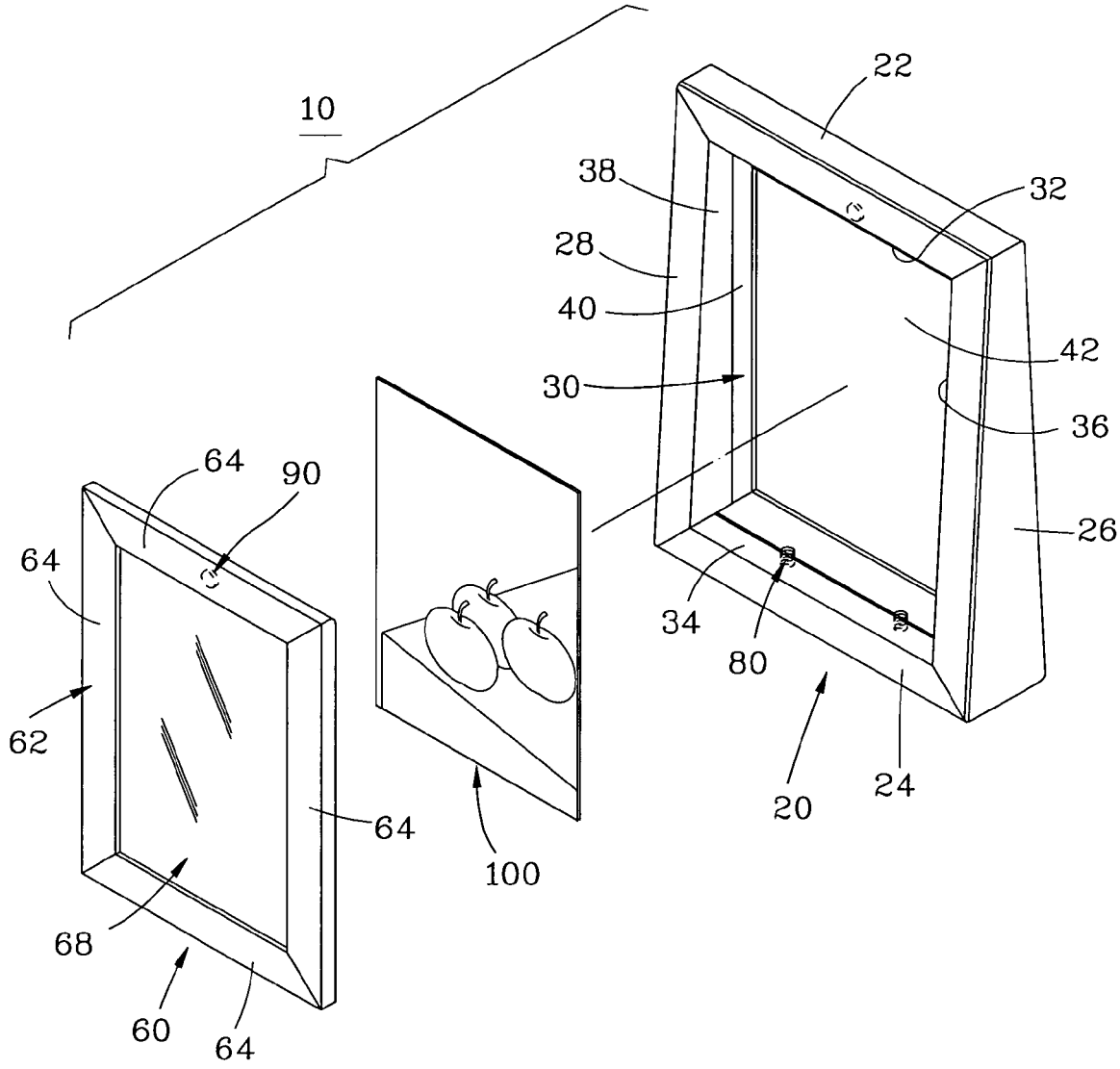
FIG. 2 is an exploded view of the picture frame assembly as shown in FIG. 1.
Figure 3:
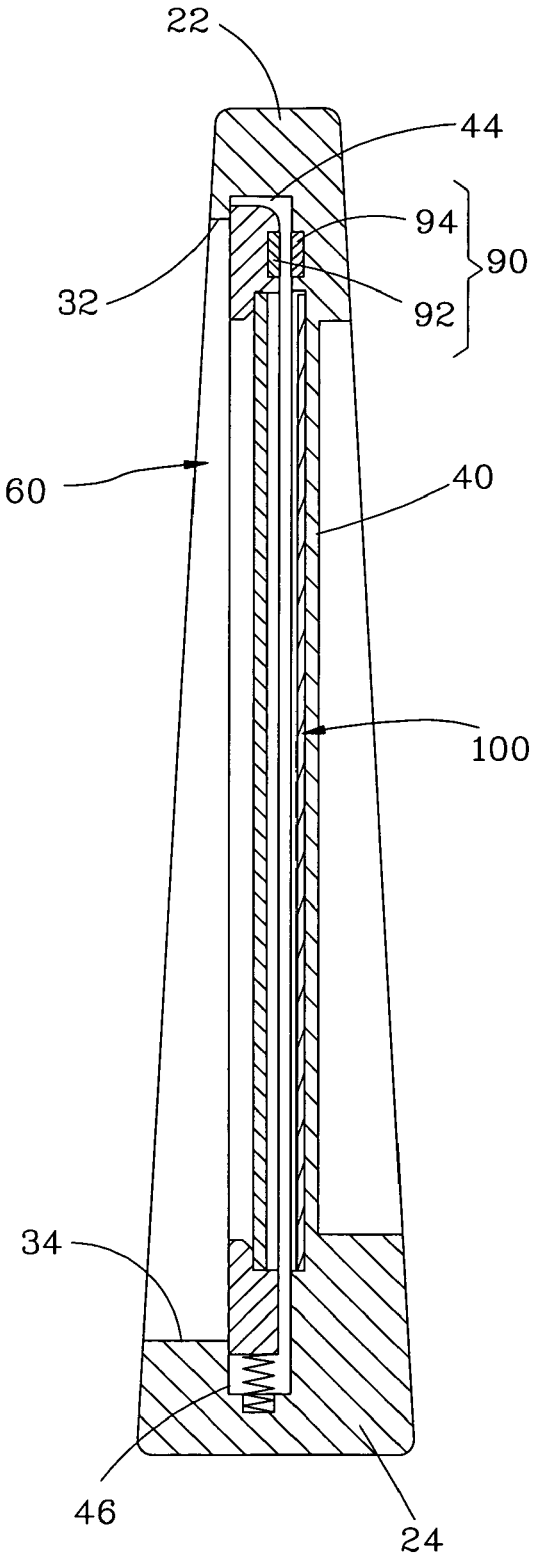
FIG. 3 is a cross-sectional view taken along line 3-3 of FIG. 1.

As shown in FIGS. 1-3, a desktop picture frame assembly 10 according to a preferred embodiment of the present invention includes a main body 20, a cover 60, a first urging means 80, and a second urging means 90.

The main body 20 includes an upper rail 22, a bottom rail 24, a right rail 26 and a left rail 28. The width of the upper rail 22 is smaller than that of the bottom rail 24, and the right and left rails 26, 28 are trapezoid so that the main body 20 can stand on a desk and define a rectangular recess 30 with four side walls indicated 32, 34, 36 and 38, and a bottom wall 40. The bottom wall 40 has a rectangular depression 42 to receive a picture 100. The upper side wall 32 of the recess 30 is provided with a first groove 44. The lower side wall 34 of the recess 30 is provided with a second groove 46.

The cover 60 includes a rectangular plate 62 with four rails, each indicated 64. The four rails 64 defines a center opening 66 receiving a rectangular pane of glass 68 to form a first transparent portion to display the picture 100 installed in the depression 42. The plate 62 is sized in such a way that the upper and lower rails 64 of the plate 62 can be set in the grooves 44, 46 whereby the plate 62 is attached to the main body 20.

It must be mentioned that the bottom wall 40 of the recess 30 can be provided with a center opening receiving a rectangular pane of glass to form a second transparent portion so that a picture installed in the a rectangular depression 42 can be displayed from the back side of the main body 20 (not shown in the FIGS.).

Figure 4:
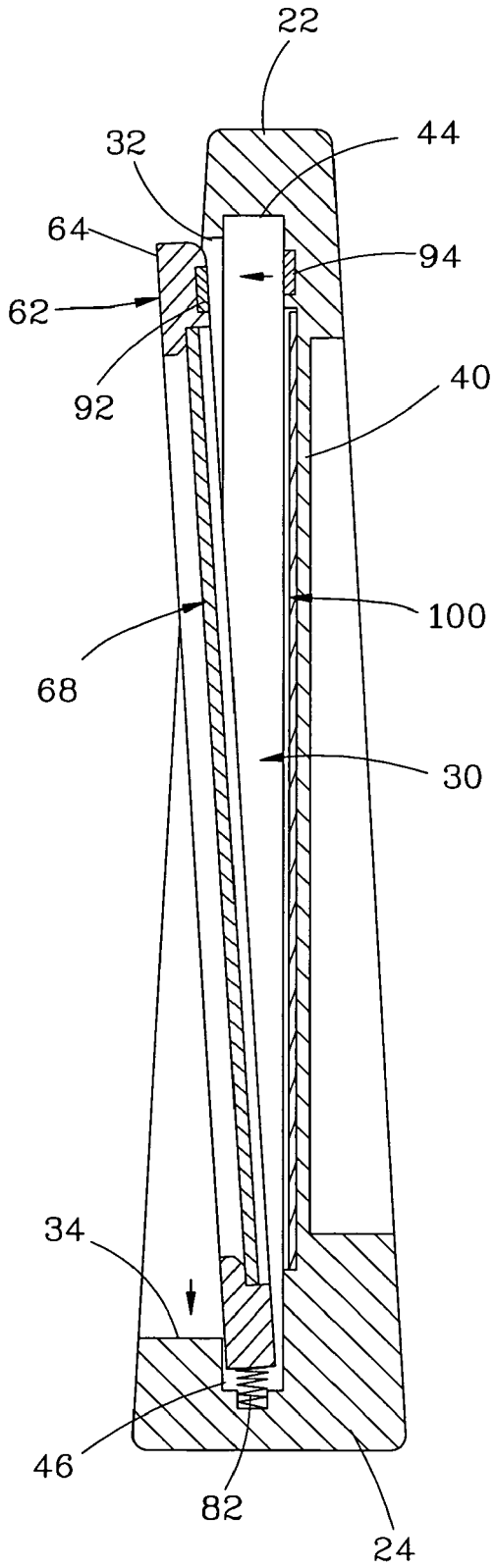
FIG. 4 is a view similar to FIG. 3 in which the press member has been removed from the main body.

The first urging means 80 includes two elastic members 82, such as a coil spring, embedded in the second groove 46 to produce a first urging force to urge against the lower rail 64 of the plate 62 such that the plate 62 can be firmly attached to the main body 20 (as shown in FIG. 3). As the plate 62 is pushed by an exterior force in the direction toward the elastic member 82, the upper rail 64 of the plate 62 is let out of the upper groove 44, thereby enabling the plate 62 to be removed from the main body 20 to facilitate the replacing of the picture 100 (as shown in the lower portion of FIG. 4).

The second urging means 90 includes a first magnetic member 92 embedded in the inner surface of the upper rail 64, a second magnetic member 94 embedded in an area of the bottom wall 40 corresponding to the first magnetic member 92. The first and second magnetic member 92, 94 have the same magnetic polarities such that they can be repelled magnetically each other to produce a second urging force to urge against the plate 62 in a departing direction when the upper rail 64 of the plate 62 is let out of the upper groove 44 (as shown in the upper portion of FIG. 4).

As described and illustrated, it should be readily appreciated that for having the first urging means 80 to produce a first urging force to urge against the cover 60 to depart the main body 20 in a vertical direction, and the second urging means 90 to produce a second urging force to urge against the cover 60 to depart the main body 20 in a horizontal direction, the picture frame assembly 10 can simply and easily install a picture into or remove it from the picture receiving portion thereof. In addition, for having the first transparent portion disposed in the cover 60 and the second transparent portion disposed in the bottom wall 40 of the recess 30, the picture frame assembly 10 can display the picture installed therein from the front side or the back side thereof.

What is claimed is:

1. A picture frame assembly comprising: a main body having a receiving portion for receiving a picture; a cover having a transparent portion, said cover being releasably attached to said main body in such a way that when said cover is attached to said main body, it can display the picture through said transparent portion; a first urging means disposed between said main body and said cover in such a way that said urging means can produce a first urging force to urge against said cover to firmly be attached to said main body, and to urge against said cover to depart from said main body in a first upward direction when said cover is released from said main body; and a second urging means disposed between said main body and said cover in such a way that when said cover is released from said main body, said second urging means produces a second urging force to urge against said cover to depart from said main body in a second horizontally outward direction, said second horizontally outward direction being perpendicular to said first upward direction, wherein said second urging means includes a first and second magnetic members being of the same magnetic polarities, said first and second magnetic members are disposed respectively in said main body and said cover in such a way that said first magnetic and second members can be repelled magnetically.

2. The picture frame assembly as defined in claim 1, wherein said receiving portion of said main body includes a recess to accommodate the picture to be displayed.

3. The picture frame assembly as defined in claim 2, wherein said recess has a bottom wall and a side wall.

4. The picture frame assembly as defined in claim 3, wherein said cover includes a plate with a center opening and a first transparent member installed in said center opening of said plate to form said transparent portion.

5. The picture frame assembly as defined in claim 4, wherein said plate has edges with a predetermined thickness and is releasably set in said side wall with said edges thereof.

6. The picture frame assembly as defined in claim 5, wherein said side wall of said recess has a first groove and a second groove opposite in location to each other, either said first groove or said second groove has a width which is larger than the thickness of the edges of said plate such that said plate can be releaseably set in said grooves with the edges thereof.

7. The picture frame assembly as defined in claim 6, wherein said first urging means includes at least one elastic member disposed in said first groove to produce said first urging force to urge against said plate firmly attached to said main body.

8. The picture frame as defined in claim 7, wherein said elastic member is a coil spring.

9. The picture frame assembly as defined in claim 4, further comprising a second transparent member which is set in said bottom wall of said recess in such a way that it can form a second transparent portion opposite to said first transparent portion.

10. The picture frame assembly as defined in claim 1, wherein said cover includes a plate with a center opening and a first transparent member installed in said center portion to form said transparent portion, and said receiving portion includes a recess to install said plate.

11. The picture frame assembly as defined in claim 10, wherein said first magnetic member is disposed in said plate, and said second magnetic member is disposed in said main body corresponding to said first magnetic member.

12. The picture frame assembly as defined in claim 1, wherein said cover includes a plate with an upper rail, a bottom rail, and a center portion, a first transparent member installed in said center portion of said plate to form said transparent portion, and said receiving portion includes a recess to install said plate.

13. The picture frame assembly as defined in claim 12, wherein said recess has a bottom wall, a side wall with a first groove and a second groove opposite in location to each other to receive said rails of said plate such that said plate can be releasably set in said main body.

14. The picture frame assembly as defined in claim 13, wherein said first magnetic member is embedded in said upper rail of said plate, said second magnetic member is embedded in said bottom wall corresponding to said first magnetic member.

15. The picture frame assembly as defined in claim 14, wherein said first urging means includes at least one elastic member disposed in said first groove to produce said first urging force to urge against said plate firmly attached to said main body.

16. The picture frame as defined in claim 15, wherein said elastic member is a coil spring.

* * * * *